United States Patent [19]

Hislop

[11] Patent Number: 4,873,501

[45] Date of Patent: Oct. 10, 1989

[54] INTERNAL TRANSMISSION LINE FILTER ELEMENT

[75] Inventor: Alfred R. Hislop, San Diego, Calif.

[73] Assignee: The United States of America as represented by the Secretary of the Navy, Washington, D.C.

[21] Appl. No.: 881,419

[22] Filed: Jun. 27, 1986

[51] Int. Cl.[4] ..... H01P 1/203; H01P 1/207; H01P 7/08

[52] U.S. Cl. ..... 333/204; 333/208; 333/222; 333/246

[58] Field of Search ..... 333/21 R, 208–212, 333/204–205, 219, 222, 223, 231, 232, 235, 236, 239, 240, 245, 246, 248, 238

[56] References Cited

U.S. PATENT DOCUMENTS

| | | | |
|---|---|---|---|
| 2,411,555 | 11/1946 | Rogers | 333/202 |
| 3,688,225 | 8/1972 | Cohn | 333/204 |
| 3,718,874 | 2/1973 | Cooper, Jr. | 333/204 |
| 3,754,198 | 8/1973 | Anghel | 333/204 |
| 3,914,713 | 10/1975 | Konishi et al. | 333/21 R |
| 4,028,650 | 6/1977 | Konishi et al. | 333/210 |
| 4,233,579 | 11/1980 | Carlson et al. | 333/204 |
| 4,313,095 | 1/1982 | Jean-Frederic | 333/204 X |
| 4,313,097 | 1/1982 | de Ronde | 333/204 |

OTHER PUBLICATIONS

Bates et al., "Finline for Microwave Integrated Circuits (MICs) at Ka-BAND (27-40 GHz)", Philips Res. Lab. (Redhill) Annu. Rev. (1978); pp. 67-68.

Konishi et al.-"New Microwave Components with Mounted Planar Circuit in Waveguide", NHK Laboratories Note, Serial No. 163, Mar. 1973; pp. 1 and 3-12.

Konishi et al.-"Microwave Filter with Mounted Planar Circuit in Waveguide", NHK Laboratores Note, Serial No. 162, Mar. 1973; pp. 1 and 3-12.

*Primary Examiner*—Marvin L. Nussbaum

*Attorney, Agent, or Firm*—Harvey Fendelman; Thomas Glenn Keough

[57] ABSTRACT

An improved transmission line filter element allows a higher difference between even and odd mode impedances than previously obtainable from planar structures. The filter element comprises a U-shaped gap formed in the strip conductor of a strip line transmission line, a microstrip structure or a suspended strip line structure. The internal transmission line filters can be cascaded to produce electromagnetic energy filters with deeper notches and steeper skirts than previously obtainable from other planar structures with the same number of elements.

15 Claims, 2 Drawing Sheets

INTERNAL TRANSMISSION LINE FILTER ELEMENT

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates generally to the field of the electromagnetic propagation devices and, more particularly, to electromagnetic transmission line structures and still more particularly to electromagnetic transmission line filter elements.

Spur transmission line filter elements are well known in the prior art and are produced by connecting two adjacent ends of a pair of coupled lines and leaving one line open circuited at the other end. The schematic electric circuit diagram illustrated in FIG. 1 shows the electric equivalent circuit of a spur transmission line. Referring to FIG. 1, first and second coupled lines 12 and 14 are connected electrically at their left ends 16 and the coupled line 14 is left open circuited at its end 18. The length, 1, of the coupled line 14 may be determined, for example, by using a Smith chart such that its end 16 appears short circuited at a specified frequency.

Referring to FIG. 2, a typical realization, in a planar medium such as strip line, of a spur transmission line filter element is illustrated. The spur transmission line filter element 20, as is well known in the prior art, is formed by creating an elbow or spur 22 extending from the strip metallic conductor 24 as is illustrated in FIG. 2. It is noted that the FIG. 2 illustration of the spur transmission line element shows only the metallic conductor portion of the strip line structure and that none of any of the dielectric material that may surround the strip line structure or any waveguide structure containing the strip line conductor element is illustrated in FIG.2.

The even and odd mode impedances $Z_{0e}.Z_{00}$ respectively, of the spur line filter element 20 are determined by the widths $W_1$ and $W_2$ and gap, $W_g$ of the structure 20 as well as the dimensions and proximity of the ground planes and surrrounding housing, if any (not shown). For example, as the gap G decreases in size, the odd mode impedance $Z_{00}$, decreases and the even mode impedance $Z_{0e}$ increases. Further, as the widths, $W_1$ and $W_2$ decrease, the even and odd mode impedance both increase. Often, filer designs require a very large difference between the even and odd mode impedances thereby requiring the gap G to become vanishingly small. While theoretically the dimension of the gap G can be calculated so as to meet the filter design requirements, the actual implementation of the circuit is not realizable because it may be physically impossible to manufacture the circuit with a gap G as narrow as may be required in order to comply with theoretical calculations. In other words, it may be physically impossible to machine the gap G so as to make it as narrow as may be necessary.

SUMMARY OF THE INVENTION

The foregoing problems associated with spur transmission line filter elements are overcome by the internal transmission line filter element of the present invention. The internal transmission line filter of the present invention provides a filter structure with very steep and deep notch and band reject filter characteristics. The invention allows coupling from both edges of the filter structure to the main transmission line while retaining a totally planar structure. The increased coupling from both edges allows a higher defference between the even and odd mode impedances and therefore deeper and steeper band reject and notch filter characteristics than have previously been obtainable for a given gap width associated with spur line filters. The invention also results in a symmetrical structure which can ease design calculations when the transmission line has conducting sidewalls as in suspended strip line structures.

The improved transmission line filter of the present invention is a bidirectional device that is implemented by a filter structure that is internal to the strip transmission line and that is furhter comprised of a U-shaped gap in the transmission A number of internal transmission line filter elements constructed in accordance with the present invention can also be cascaded as will be further described to provide a notch or band reject filter with the desired characteristics.

OBJECTS OF THE INVENTION

Accordingly, it is the primary object of the present invention to provide a transmission line filter element structure with very steep and deep notch and band reject filter characteristics.

It is a further object of the present invention to disclose a transmission line filter element for inclusion in an electromagnetic transmission line that eliminates the problem of narrowing the gap associated with spur transmission line filters.

Other objects and further aspects of the present invention will become apparent during the course of the following description and by reference to the accompanying drawings.

DESCRIPTION OF THE PREFERRED EMBODIMENT

Figure 1:
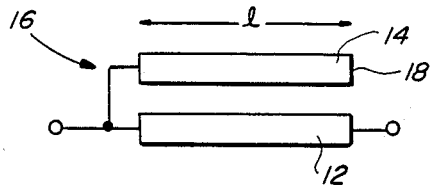
(PRIOR ART) FIG. 1
FIG. 1, as previously referred to, is an electric circuit schematic diagram of a spur transmission line filter element.
Figure 2:
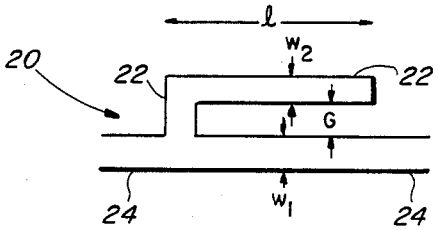
(PRIOR ART) FIG. 2
FIG. 2 is a top view of a prior art spur line filter, as previously described, illustrating only the metallic conductor portion of the spur line filter.
Figure 3:
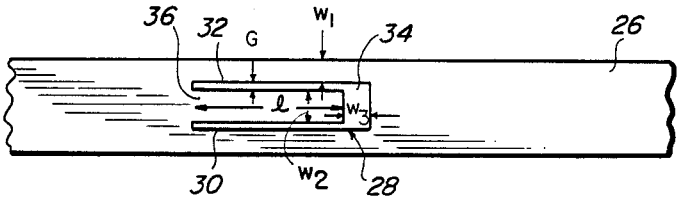
FIG. 3 is a top view of the transmission line filter element of the present invention illustrated with any dielectric, supporting substrate and/or surrounding housing removed.

The internal transmission line filter element of the present invention will now be described with references to FIGS. 3, 4, 5, 6, 7, 8 and 9. The internal transmission line filter element of the present invention takes the general form illustrated in FIG.3. Conductor 26 is the center conductor of a strip transmission line or it may also be the top conductor opposite the ground plane in a microstrip transmission line. Alternately, conductor 26 may be the center conductor of a suspended stripline structure as will be further described below and illustrated in the drawings. Conductor 26 is preferably a highly conductive metal such as copper. A U-shaped slot or gap 28 is made in the conductor 26 that is part of the transmission line. The U-shaped gap 28 may be formed photolithographically as is well known. The U-shaped gap 28 is comprised of first and second side legs 30 and 32 and a bottom leg 34. The longitudinal axes of the side legs 30 and 32 are parallel or substantially parallel to the longitudinal axis of the conductive strip 26. The portion 36 of the conductive strip 26 that extends into the area encompassed by the U-shaped gap 28 is coupled to the adjacent remainder of the conductive strip 26 on either side of the gap side legs 30 and 32. The odd and even mode parameters of the transmission line filter element of the present invention may be determined and varied by varying the widths $W_1$, $W_2$, the gap width G, the dielectric constant of any dielectric used in conjunction with the strip conductor 26 such as for instance, the supporting dielectric substrate, if any, or the air dielectric surrounding the strip conductor, if any, and by the size and dimensions of the waveguide housing cavity, if any. The dimension $W_3$ will affect the resonant frequency but not mode impedances. The length l of the side legs 30 and 32 of the U-shaped gap 28 should be $(\lambda/4)$ where $\lambda=(c/f)$ and where c equals the velocity of the light and f is the center frequency of the notch or reject band of the filter. The widths $W_1$ and $W_2$, can thus be chosen judiciously to obtain appropriate values of even and odd mode impedances for the transmission line.

Figure 4:
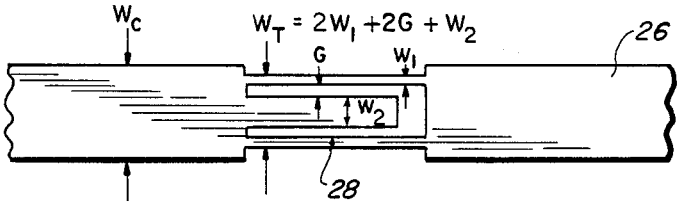
FIG. 4 is a top view of a transmission line filter element constructed in accordance with the present invention illustrated with the dielectric, supporting substrate and/or surrounding housing removed and illustrating the teaching of the present invention of reducing the total width of the filter section with respect to the transmission line.

Referring now to FIG. 4, there is also illustrated a U-shaped gap structure 28 in a conductor 26 that is part of a transmission line. FIG. 4 illustrates that the total width $W_T$ of the internal transmission line filter element need not be the same as the width $W_c$ of the conductor 26.

Figure 5:
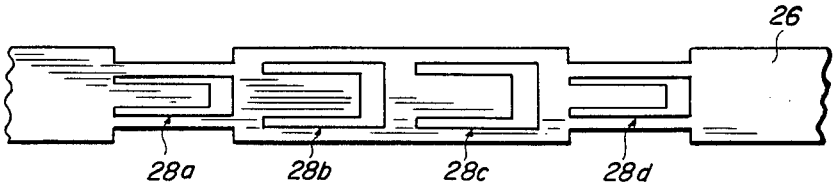
FIG. 5 is a top view of a transmission line filter element constructed in accordance with the present invention with dielectric, supporting substrate and/or surrounding housing removed and illustrating the teaching of the present invention of cascading a series of U-shaped gaps to form an internal filter element in accordance with the present invention.

Referring to FIG. 5, another variation of the present invention is illustrated. In FIG. 5 it can be seen that a number of U-shaped gap internal transmission line filter elements **28*a*, 28*b*, 28*c* and 28*d* can be cascaded to provide a notch or band reject filter with the desired characteristics. It is to be understood that although each of the cascaded internal filter elements 20, 28a, 28b, 28c and 28d** are illustrated with their open ends all facing in the same direction, one or more of the internal filter elements may be reversed such that their open ends face in the opposite direction illustrated in FIG. 5.

Figure 6:
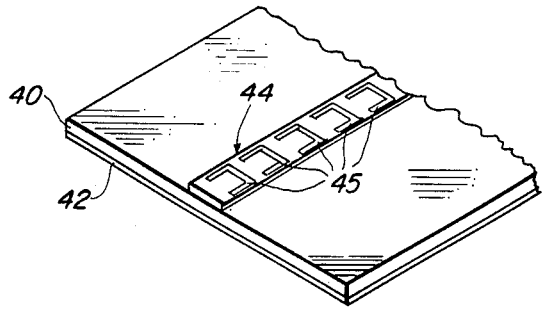
FIG. 6 is an isometric view of a microstrip implementation of the present invention.
Figure 7:
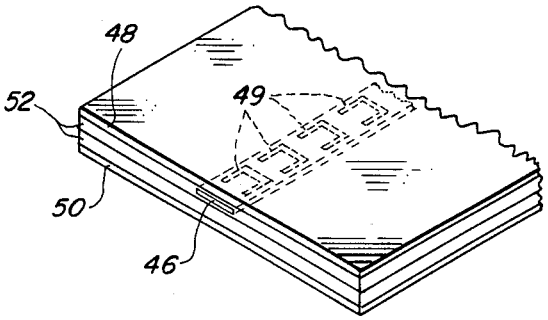
FIG. 7 is an isometric view of a stripline implementation of the present invention.

FIG. 6 illustrates how the U-shaped gap transmission line filter element of the present invention may be utilized in a microstrip structure. For instance, a microstrip device may be formed on a dielectric substrate 40 which may comprise Teflon with glass microfibers such as Duroid or it may comprise pure Teflon or any other suitable dielectric substrate material as is well known. As is also well known the bottom surface of the dielectric substrate 40 is coated with a metallic ground plane 42 preferably comprised of copper. A microstrip conductor pattern 44 is then formed on the top surface of the dielectric substrate. The microstrip conductor pattern 44 may, in accordance with the present invention, include in one or more of the conductor sections thereof a transmission line filter element as configured, for example, in FIG. 5. Similarly, as is illustrated in FIG. 7, a stripline transmission line may be formed by placing a conductive pattern 46 between ground planes 48 and 50 which are separated by dielectric material 52. The metallic, preferably copper, conductive portion 46 of the stripline structure may contain in one or more of the stripline conductor sections a transmission line filter element 49 as configured by way of example in FIG. 5.

Figure 8:
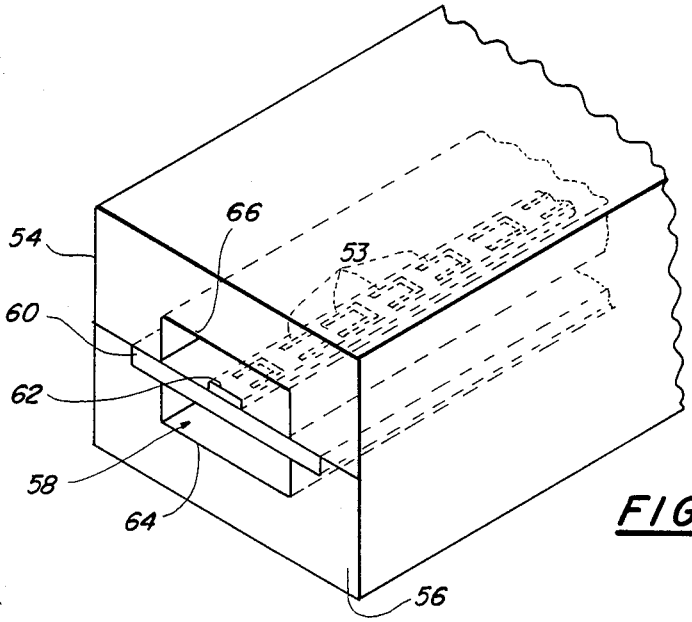
FIG. 8 is an isometric view of a suspended strip line implementation of the present invention.
Figure 9:
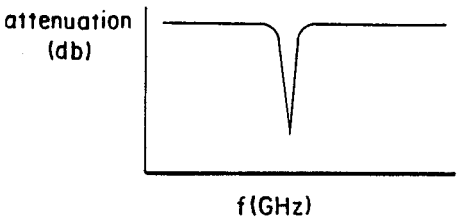
FIG. 9 is a graph of attenuation versus frequency illustrating the deep notch and band reject filter characteristics achievable with the present invention.

FIG. 8 illustrates how a suspended stripline device may be formed and may include one or more of the transmission line filter elements 53 of the present invention. In FIG. 8, metallic waveguide housing sections 54 and 56 are joined together to create waveguide cavity 58 and to sandwich between them dielectric substrate 60 which contains on its top surface a strip conductor or strip conductor section 62 containing one or more of the transmission line filter elements 53 of the present invention. In the suspended strip line embodiment illustrated in FIG. 8, the waveguide broadwalls 64 and 66 should be less than $(\lambda/2)$ in width where $\lambda=(c/f)$ where c is the velocity of light and f is the highest operating frequency of the device. Broadwalls of this dimension eliminate the propagation of sporious waveguide modes. FIG. 9 illustrates by way of example the very steep and deep notch and band reject filter characteristics achievable by utilization of the internal U-shaped gap transmission line after element of the present invention, where the attenuation in decibels the transmitted electromagnetic signal level is plotted verses frequency.

By way of example, a U-shaped transmission line filter element constructed in accordance with the present invention to reject the frequency band between the frequencies 47.5 and 48.5 GHZ can be constructed in accordance with the following parameters:

$W_1=0.0058$
$W_2=0.0050$
$W_3=0.0057$
$G=0.0032$
$L=0.0451$
Waveguide narrow wall dimension=0.050
Waveguide broad wall dimension=0.098

Obviously, many modifications and variations of the present invention are possible in the light of the above teachings. For instance, the U-shaped gap of the present invention can be used in any transmission line that propagates electromagnetic energy including waveguide, and is not restricted to the microstrip, stripline or suspended stripline embodiments illustrated and described. It is therefore to be understood that within the scope of the appended claims the invention may be practiced otherwise than as specifically described.

I claim:

1. A transmission line filter element for inclusion in a transmission line that propagates electromagnetic energy, said transmission line having a longitudinal axis comprising:

a strip of conductive material positioned within said transmission line said strip of conductive material comprising one of the conductors of said transmission line; and means for rejecting the propagation of a band of frequencies of electromagnetic energy through said transmission line comprising a U-shaped gap positioned within said strip of conductive material, said U-shaped gap having first and second side legs that are gaps in said strip of conductive material and further having a bottom leg, positioned between said first and second side legs, said bottom leg being a gap in said strip of conductive material, said first and second side legs having first and second longitudinal axes, said first and second longitudinal axes being parallel to said longitudinal axis of said transmission line.

2. The transmission line filter element of claim 1 wherein:

said strip of conductive material is metallic.

3. The transmission line filter element of claim 2 wherein said metallic material is copper.

4. The transmission line filter element of claim 1 wherein:

said strip of conductive material is an elongate strip.

5. The transmission line filter element of claim 1 wherein:

a portion of said conductive material extends into the space between said first and second legs.

6. The transmission line filter element of claim 1 wherein:

each of said first and second side legs is approximately $\lambda/4$ long where $\lambda=(c/f)$ and where c=the velocity of light and f is the center frequency of said transmission line filter.

7. The transmission line filter element of claim 1 wherein:

said strip of conductive material is supported on a dielectric substrate.

8. The transmission line filter element of claim 7 wherein:

said transmission line filter element is enclosed in a waveguide housing having first and second broadwalls and first and second narrow walls and wherein said dielectric substrate is suspended within said waveguide housing and positioned orthogonally to said narrow walls.

9. The transmission line filter element of claim 8 wherein:

the width of said waveguide broadwalls is less than $\lambda/2$ wide where $\lambda=(c/f)$ and where c=the velocity of light and f=the highest operating frequency of said transmission line.

10. The transmission line filter element of claim 9 wherein:

the height of said waveguide narrow wall is less than $\lambda/2$ wide.

11. The transmission line filter element of claim 7 wherein:

said dielectric substrate has a ground plane conductor on the side of it opposite from said strip of conductive material.

12. The transmission line filter element of claim 1 wherein:

said strip of conductive material is sandwiched between first and second

13. The transmission line filter element of claim 12 wherein:

dielectric material fills the space between said strip of conductive material and said first and second ground plane conductors.

14. A transmission line filter element for inclusion in a transmission line that propagates elecromagnetic energy and that has a longituidnal axis comprising:

a strip of conductive material positioned within said transmission line, said strip of conductive material comprising one of the conductors of said transmission line; and means for rejecting the propagation of a band of frequencies of electromagnetic energy through said transmission line comprising a plurality of U-shaped gaps positioned within said strip of conductive material, each of said U-shaped gaps having first and second side legs that are gaps in said strip of conductvie material and further having a bottom leg, positioned between said first and second side legs, said bottom leg being a gap in said strip of conductive material, said first and second side legs having first and second longitudinal axes, said first and second longitudinal axes being parallel to said longitudinal axis of said transmission line.

15. In a transmission line for propagating electromagnetic energy and including a strip of conductive material, said strip of conductive material comprising one of the conductors of said transmission line, surrounded by dielectric material, the improvement comprising a transmission line filter element positioned within said strip of conductive material, said transmission line filter element consisting of:

a U-shaped gap, said U-shaped gap having first and second side legs having first and second longitudinal axes, respectively, said transmission line having a longitudinal axis, and said first and second longitudinal axes being parallel to said transmission line longitudinal axis.

* * * * *